United States Patent [19]

Schaffner et al.

[11] Patent Number: 5,074,743

[45] Date of Patent: Dec. 24, 1991

[54] LAYBOY FOR DEPOSITING SHEETS, ESPECIALLY SHEETS OF PAPER, ON A STACK BY COUNT

[75] Inventors: Georg Schaffner, Neuss; Ernst Claassen, Goch, both of Fed. Rep. of Germany

[73] Assignee: Jagenberg Aktiengesellschaft, Dusseldorf, Fed. Rep. of Germany

[21] Appl. No.: 494,043

[22] Filed: Mar. 15, 1990

[30] Foreign Application Priority Data

Apr. 12, 1989 [DE] Fed. Rep. of Germany ..... 3911969

[51] Int. Cl.[5] ..... B65H 31/32

[52] U.S. Cl. ..... 414/790.8; 271/218

[58] Field of Search ..... 271/218, 217; 414/790.8, 790.1, 790.2, 790.7

[56] References Cited

U.S. PATENT DOCUMENTS

| | | | |
|---|---|---|---|
| 4,436,472 | 3/1984 | Kunzmann | 414/790.8 |
| 4,478,403 | 10/1984 | Byrt | 271/218 X |
| 4,551,053 | 11/1985 | Ishibashi . | |
| 4,796,879 | 1/1989 | Martini et al. | 271/218 |
| 4,878,659 | 11/1989 | Besemann | 271/218 |

FOREIGN PATENT DOCUMENTS

| | | |
|---|---|---|
| 2709103 | 9/1977 | Fed. Rep. of Germany . |
| 3122451 | 2/1982 | Fed. Rep. of Germany . |
| 3304673 | 8/1984 | Fed. Rep. of Germany . |
| 3422635 | 12/1985 | Fed. Rep. of Germany . |
| 3616470 | 6/1987 | Fed. Rep. of Germany . |
| 3739194 | 6/1989 | Fed. Rep. of Germany . |
| 647735 | 2/1985 | Switzerland . |

*Primary Examiner*—David A. Bucci
*Assistant Examiner*—Janice Krizek
*Attorney, Agent, or Firm*—Sprung, Horn, Kramer & Woods

[57] ABSTRACT

A layboy for depositing sheets, especially sheets of paper, on a stack by count, with a layoff platform that travels up and down; forks that are positioned at the rear of the stack and that travel horizontally into and out of the vicinity of the stack and up and down; and an auxiliary stack platform that travels up and down and into the vicinity of the layoff platform behind the stack. To deposit sheets more rapidly onto relatively low stacks without losing sheets, the layboy includes at least three independently moving forks (20.1, 20.2 and 20.3); positioning mechanisms (23 and 25) that travel up and down behind the stack and engage and position the forks while they are in the vicinity of the stack; and a lift (24) positioned behind and away from the stack with a device (26) for gripping and moving the forks away from the stack, for lifting them up to the infeed level, and for introducing them into the vicinity of the stack and transferring them to the engaging and positioning mechanisms.

8 Claims, 5 Drawing Sheets

LAYBOY FOR DEPOSITING SHEETS, ESPECIALLY SHEETS OF PAPER, ON A STACK BY COUNT

The invention concerns a layboy for depositing sheets, especially sheets of paper, on a stack by count.

BACKGROUND OF THE INVENTION

A layboy of this type is known from German OS 3 616 470. It is employed to replace the stack without interrupting the supply of sheets to the stacking point. The complete stack can be replaced with no wasted sheets and without the risk of shifting any sheets out of place. The layboy has means of forwarding overlapping sheets to a stacking point, where there is a layoff platform that travels up and down. At the rear of each stack is a separating mechanism that moves up and down and consists of a pivoting arm with a sheet-metal separator on its free end, two jaws, one higher than the other and both capable of moving vertically and in the direction the sheets travel in, and an auxiliary stack platform that can be advanced in the direction of travel and lowered. The separating mechanism that moves up and down can be advanced to the top of the stack, especially between the top sheet on the stack and the overlapping stream, between the rear edges of the sheets. The separating mechanism and the jaws are in the form of a fork or grate and are laterally displaced to allow the jaws to extend through the separating mechanism.

To replace the stack, the jaws enter gaps left by the separating mechanism between the rear edges of the sheets and secure a bunch of sheets, while the auxiliary stack platform travels in or out. The auxiliary stack platform supports the top of the stack while the bottom of the stack is removed.

The layboy disclosed in German OS 3 616 470 is designed for establishing relatively large stacks on pallets. It is not as appropriate for depositing sheets onto a stack when the count is only 500 or 1000 sheets for example because the lower jaw must for reasons of design be relatively far away from the infeed level, which dictates the smallest possible stack.

The principal object of the present invention is to provide a generic layboy that deposits sheets more rapidly onto stacks that are not as high without losing sheets.

SUMMARY OF THE INVENTION

The aforementioned object is attained by the present invention.

The layboy in accordance with the invention has at least three forks that can be advanced one after another into the growing stack. Between each pair of forks are enough sheets to equal the count. These sheets can be removed separately and in sequence without having to interrupt the supply of sheets. The individual forks perform one after another in the stack the function of the upper and lower jaws disclosed in German OS 3 616 470 and, once they have been withdrawn from the stack in their lowermost position, they are raised again by a separate lifting mechanism and advanced back into the stack.

BRIEF DESCRIPTION OF THE DRAWINGS

One embodiment of the invention will now be described with reference to the drawings, wherein FIG. 5 is a view of the mechanisms along the direction the sheets travel in.

DESCRIPTION OF THE PREFERRED EMBODIMENTS

Figure 1:
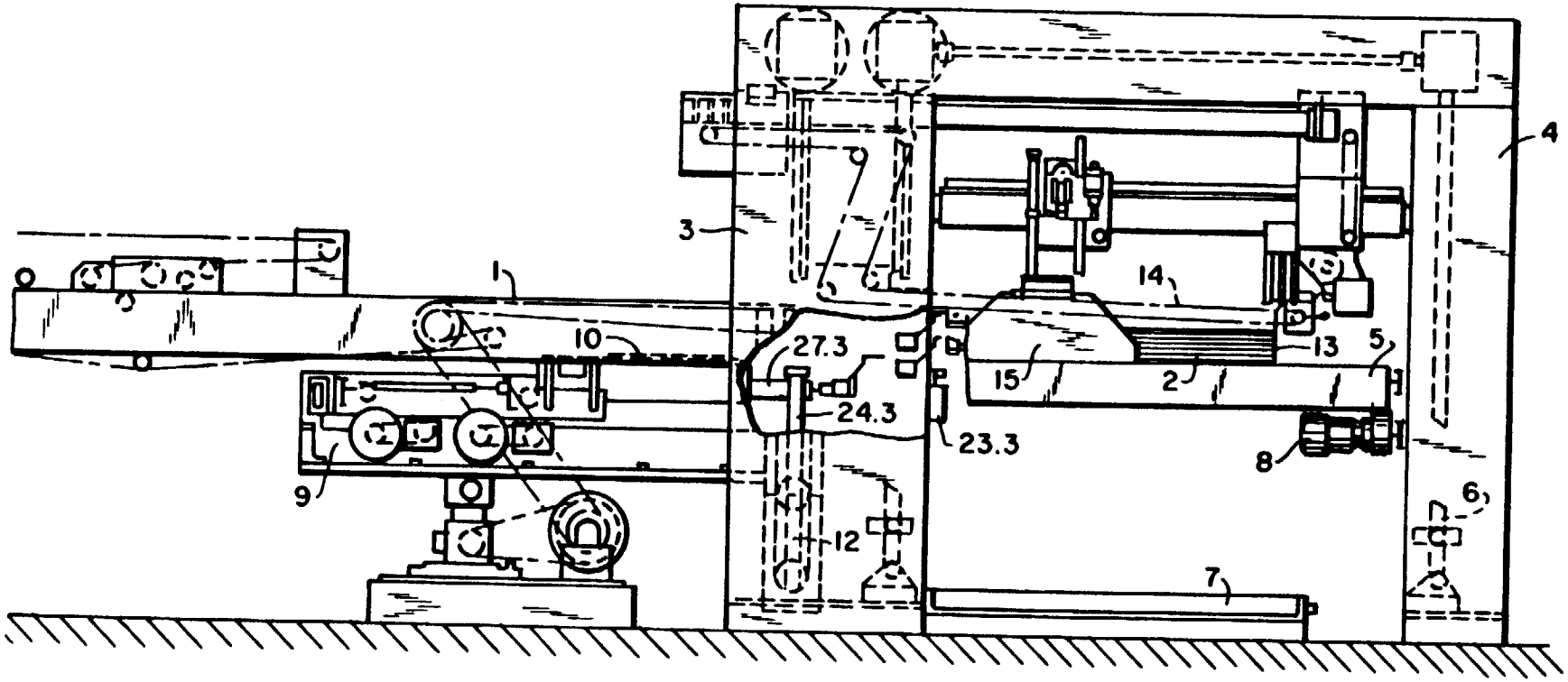
FIG. 1 is a side view of a layboy in accordance with the invention.

The layboy illustrated in FIG. 1 is employed for laying sheets of paper supplied overlappingly on belts 1 from an upstream sheeter onto a stack 2. The framework of the layboy has four uprights 3 and 4, inside which a spindle-driven lifter 6 can raise a layoff platform 5 from the level on which the sheets are supplied to a belt conveyor 7 that removes them at an angle. Platform 5 comprises a loop of cloth driven by a motor 8 and transfers a stack that is up to the count to transverse conveyor 7, which forwards it to a downstream packing machine.

Below the infeed level and at the intake end upstream of uprights 3 is a carriage 9 with an auxiliary stack platform 10 mounted on it. The carriage moves this platform horizontally into and out of the stacking area. Carriage 9 and auxiliary stack platform 10 can also be raised and lowered by a spindle-driven lifter 12. The downward motion is synchronized with the downward motion of layoff platform 5 in that lifter 12 is coupled to lifter 6. The layboy also has the conventional stop board 13, upper tapes 14, and lateral jogger 15.

Figure 2:
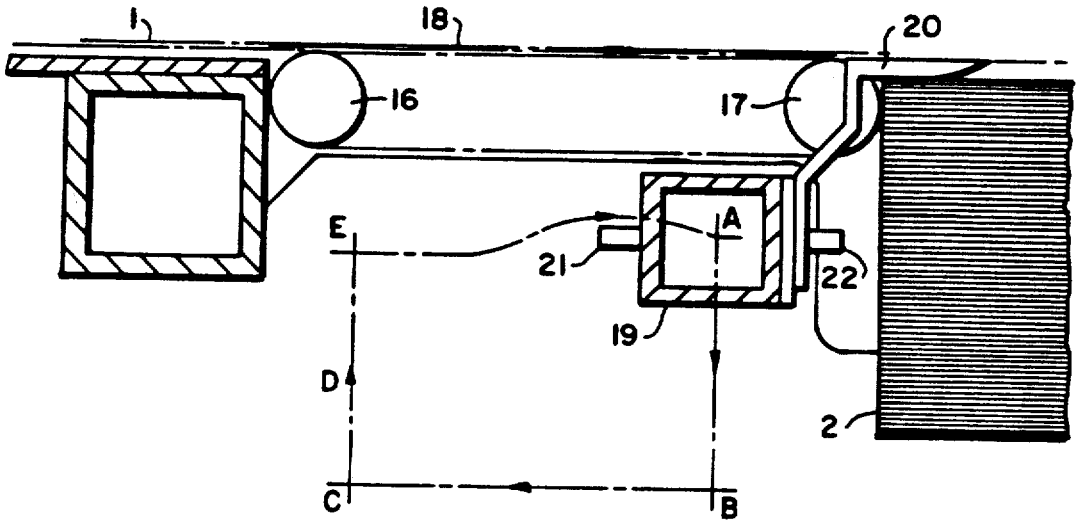
FIG. 2 is an enlarged section of the vicinity of the kick-out section with a curve representing the motion of a fork.
Figure 3:
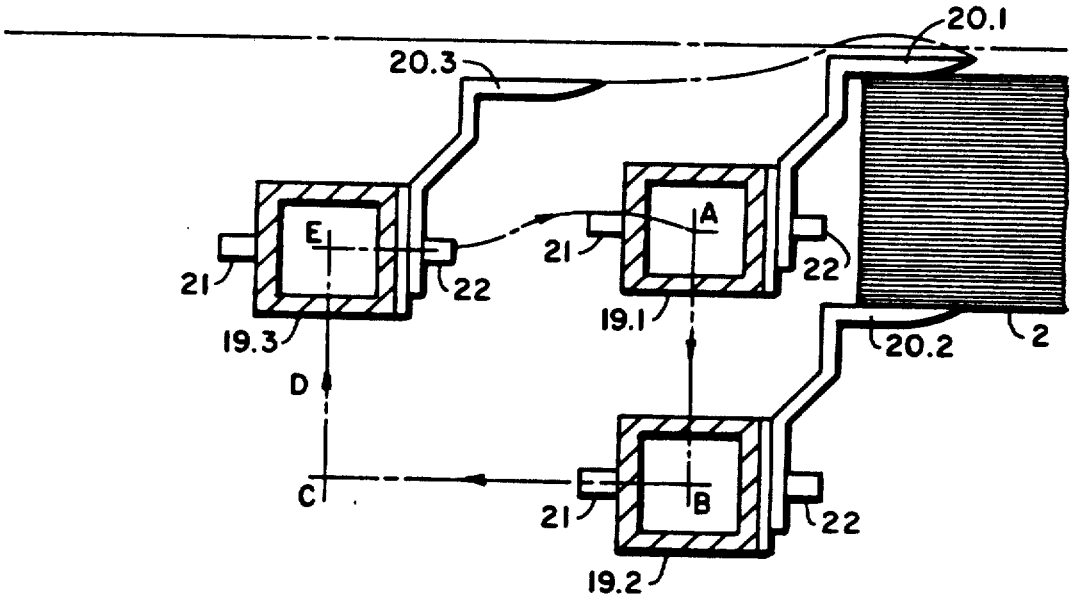
FIG. 3 is a schematic illustration of the relative position of the three forks.
Figure 4:
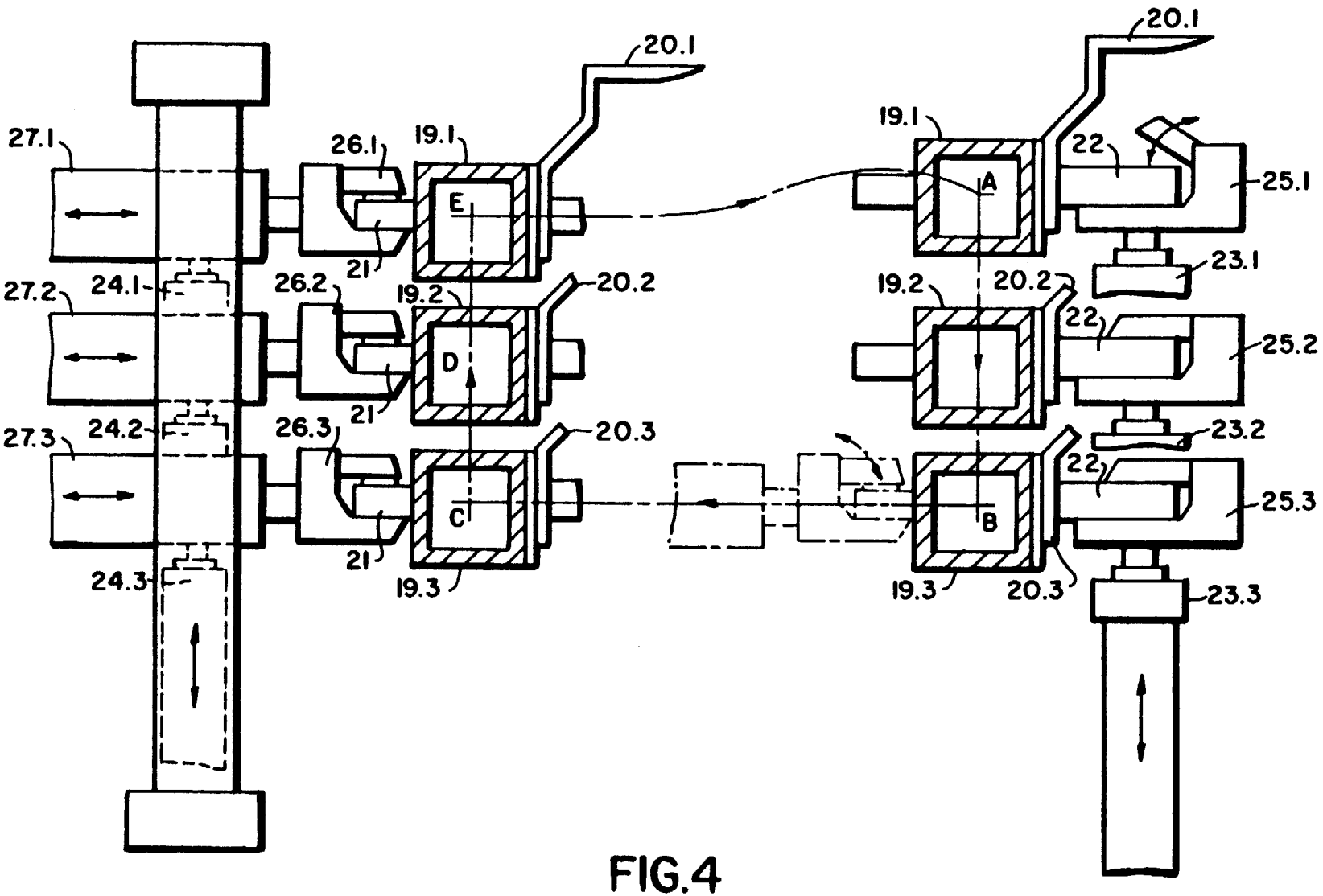
FIG. 4 is a schematic side view illustrating the mechanisms that move the forks.
Figure 5:
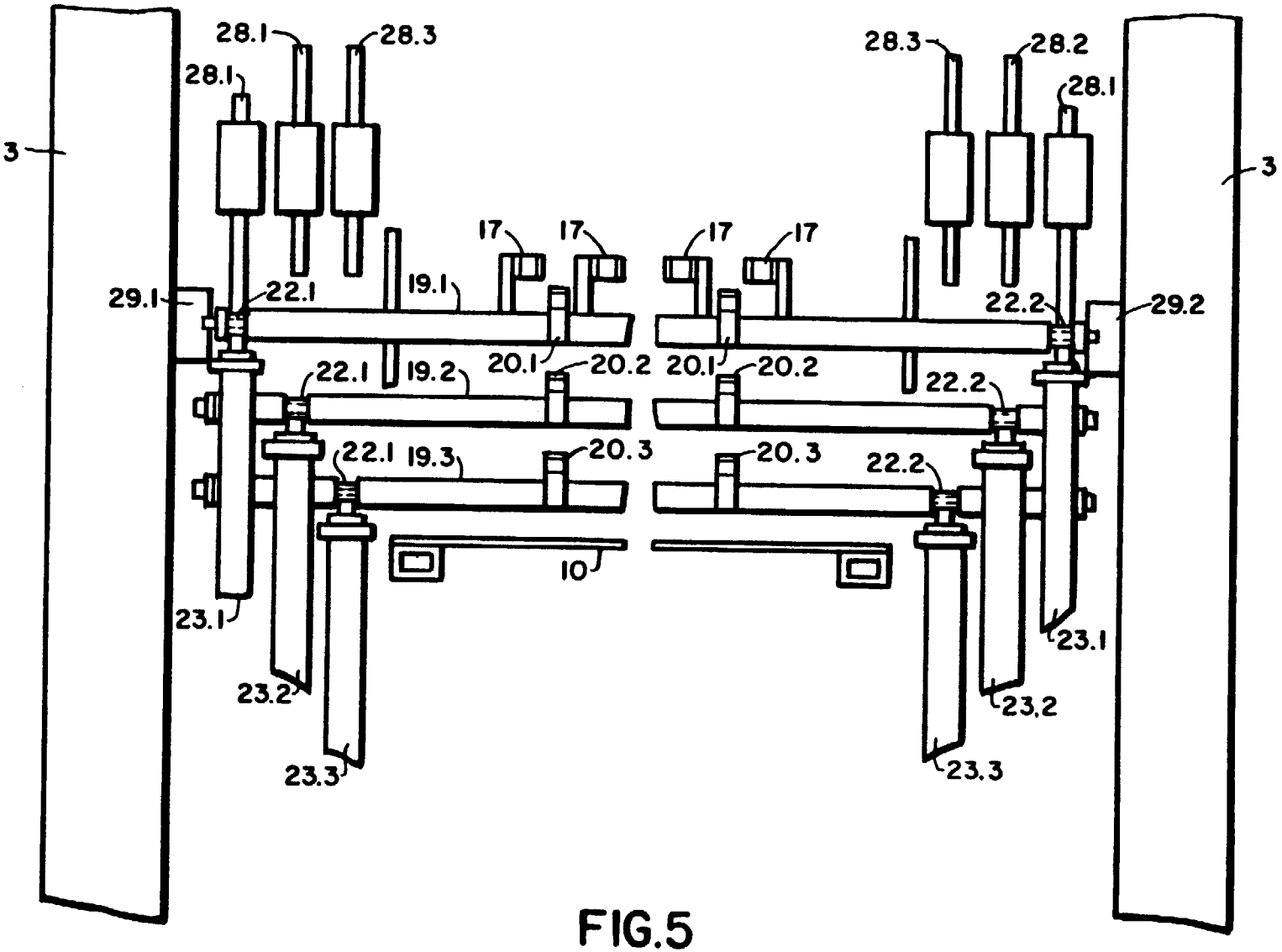
Figure 5A:
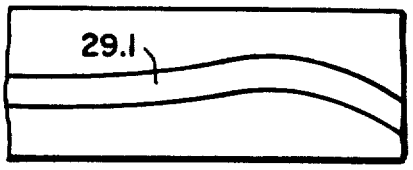
FIG. 5A is a side view of the apparatus shown in FIG. 5 indicating the configuration of the guides.

FIG. 2 is an enlarged illustration of the kick-out section, which is at the infeed level between the two front uprights 3. A belt conveyor 1 comprises several separate and parallel straps traveling around pulleys 16 and 17. Outlet-end pulleys 17 are as long as the width of a stack and are positioned directly upstream of stack 2. The overlapping sheets 18 are accordingly deposited on the stack in a known way. Below belt conveyor 1, three beams 19.1, 19.2, and 19.3 extend across the operating width (FIG. 3). Attached to the side of each beam facing the outlet end is a respective fork 20.1, 20.2, and 20.3. The forks are far enough away from one another that they can be raised between the straps and pulleys 17. The ends of forks 20 are bent horizontal and can be introduced into the vicinity of stack 2 and applied to the intake-end rear edge of the stack. On the front and rear side of each beam 19 and outside of the operating width is a projection 21 and 22. These projections are engaged by the grippers illustrated in greater detail in FIG. 4, which move them along a continuous path ABCDE in conjunction with forks 20. The two projections 21 and 22 from one beam 19 are horizontally displaced in relation to those on the other beam.

Mounted on each of the two lateral and forward uprights 3 and outside the operating width are six pneumatic piston-and-cylinder units 23.1, 23.2, and 23.3 and 24.1, 24.2, and 24.3. Each unit can raise respective pneumatic grippers 25.1, 25.2, and 25.3 and 26.1, 26.2, and 26.3. The grippers 25 at the outlet end and next to the rear edge of the stack can only be moved up and down, whereas upstream grippers 26 can be moved both up and down, and, by piston-and-cylinder units 27, horizontally into the vicinity of the rear edge of the stack. This system makes it possible to move the three beams 19 along with their forks 20 along a continuous path ABCDE (FIG. 2), with the downstream projection 22 of a beam 19 at point A being engaged by a gripper 25, which then lowers it to point B. At that point projection 22 is released by gripper 25 and the projection 21 on beam 19 is engaged by gripper 26, which, driven by piston-and-cylinder units 27, shifts it upstream (toward the left in FIG. 4) to point C. Point C is too far away from points A and B to impede the descent of the subsequent beams 19 and forks 20. From point C, grippers 26, driven by piston-and-cylinder units 24, raise beam 19 to position D and hence along an upward and horizontal curve back to point A, where forks 20 rest against the top of stack 2 and where they are again engaged by gripper 25.

The lateral uprights 3 contain guides 29.1 and 29.2 that precisely dictate the motions of beams 19 from point E to point A along the path illustrated in FIG. 2. There is also a spindle-driven lifter 28.1, 28.2, and 28.3 above each outlet-end piston-and-cylinder unit 23 with its spindle pressing down against the force of the unit on the projection 22 on each beam. Lifters 28 are controlled by an unillustrated mechanism in such a way as to ensure that beams 19 descend from point A to point B, while forks 20 are in stack 2, in synchronization with layoff platform 5 or auxiliary stack platform 10. Lifters 28 also operated in conjunction with piston-and-cylinder units 23 to move an upper fork 20 and a lower fork 20 together and secure a bunch of sheets together to allow auxiliary stack platform 10 to travel in and out unimpeded.

Other similar mechanisms, hydraulic piston-and-cylinder units for example, can be employed instead of spindle-driven lifters 6 and 28.

How the layboy operates will be evident from FIGS. 6 through 11.

Layoff platform 5 descends while overlapping sheets 18 are being deposited on stack 2 to ensure that each sheet drops the same distance as it leaves belt conveyor 1.

Figure 6:
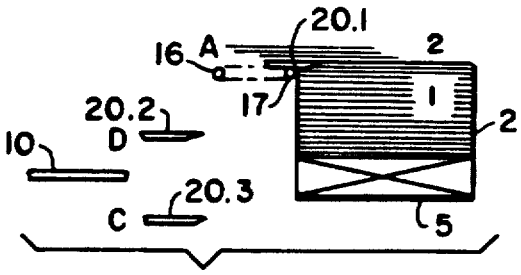
FIGS. 6 through 11 illustrate how a layboy in accordance with the invention functions.
Figure 7:
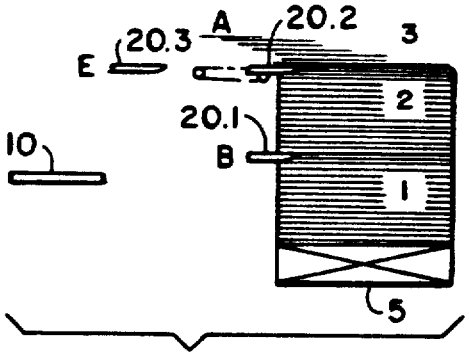
Figure 8:
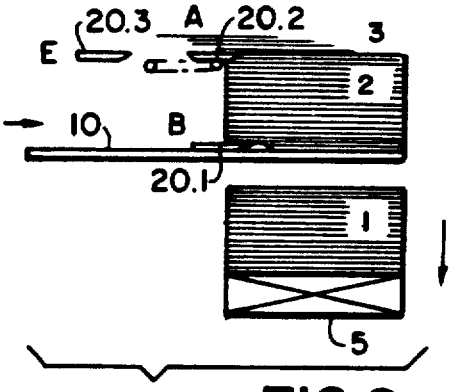
Figure 9:
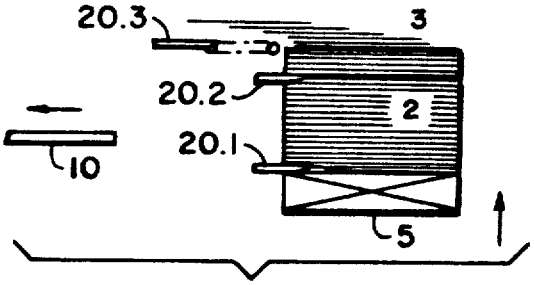

Once enough sheets 18 to equal the count (e.g. 500) have been deposited, first fork 20.1 travels between the top sheet of stack 2 and the arriving overlapping sheets and into the vicinity of the stack (FIG. 6). While it is traveling in, the fork is also raised in order to lift sheets 18 and produce a gap between their rear edges and accordingly prevent a collision at that edge. Forks 20.2 and 20.3 on the other hand are in the ready position at the bottom midpoint (D or C) remote from the rear edge of the stack. As layoff platform 5 descends, the associated lifter 28.1 forces fork 20.1 down in synchronization. While a full stack is being deposited above fork 20.1, forks 20.2 and 20.3 are moved into the upper ready position D by the associated piston-and-cylinder units 24.2 and 24.3. Once the stack above fork 20.1 equals the prescribed count, fork 20.2 travels between the rear edges of the sheets and, in conjunction with fork 20.1, secures the bunch of sheets between them. Fork 20.3 is simultaneously advanced into the upper ready position E (FIG. 7). An accelerated lowering of layoff platform 5 produces a gap below fork 20.1 into which auxiliary stack platform 10 can be introduced (FIG. 8). The full stack below auxiliary stack platform 10 is then accelerated down along with layoff platform 5 and transferred to transverse conveyor 7. Fork 20.1 and fork 20.2 and auxiliary stack platform 10 are simultaneously continuously lowered as stack 2 grows, maintaining the top at approximately the same level. Once the empty layoff platform 5 has again been raised under auxiliary stack platform 10, the latter is extracted from the stack (FIG. 9).

Figure 10:
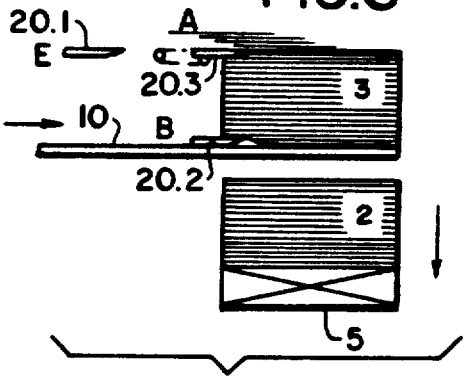
Figure 11:
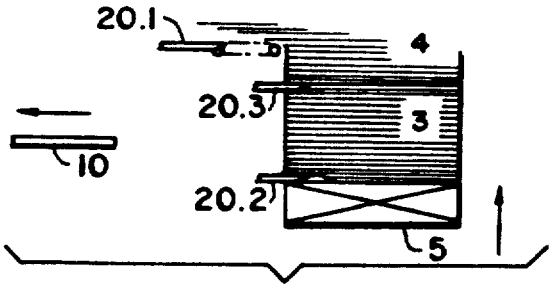

Upon attaining the same level as lower position B, fork 20.1 is taken over by gripper 26.1 and shifted horizontally out of the stack and into lower ready position C by piston-and-cylinder unit 27.1 and then into upper ready position E by piston-and-cylinder unit 24.1. Ready position E is available because the stack above fork 20.2 has by now attained its count and fork 20.3 has been introduced into the stack. Fork 20.3 securely holds the complete stack in conjunction with fork 20.2 (FIG. 10). Layoff platform 5 is accelerated down again and auxiliary stack platform 10 is advanced below fork 20.2 into the resulting gap. Once the full stack below auxiliary stack platform 10 has been removed, the empty layoff platform 5 has been lifted, and auxiliary stack platform 10 has been extracted, the components will be in the positions illustrated in FIG. 11. This is the position illustrated in FIG. 9 but with forks 20.1, 20.2, and 20.3 cyclically advanced. The sequence is repeated with the positions of forks 20.1, 20.2, and 20.3 alternating.

It will be understood that the specification and examples are illustrative but not limitative of the present invention and that other embodiments within the spirit and scope of the invention will suggest themselves to those skilled in the art.

What is claimed is:

1. A layboy for depositing sheets on a stack by count, comprising:

a layoff platform that travels up and down and supports a stack of sheets that are fed individually at an infeed level with their leading edges forming the front of the stack and their trailing edges forming the rear of the stack, at least three independently moving forks (20.1, 20.2 & 20.3) that are positioned at the rear of the stack and that travel up and down and horizontally toward and away from the stack, said forks being inserted into the stack when in a position closest thereto, and an auxiliary stack platform positioned at the rear of the stack and that travels up and down and toward and away from the stack, first means (23 & 25) that travel up and down at the rear of the stack and engage and position the forks while they are inserted into the stack, and second means (24 & 26), positioned at the rear of and further away from the stack than the first means, for gripping and moving the forks away from the stack, for lifting them up to the sheet infeed level at the top of the stack, and for inserting them into the stack and transferring them to the first means.

2. A layboy according to claim 1, wherein the forks (20) are distributed in a row along a beam (19) and each fork is bent horizontally at one end.

3. A layboy according to claim 1, wherein said second means include vertical piston-and-cylinder units (24) positioned at the rear of the stack, each with an engaging and positioning mechanism in the form of a gripper (26).

4. A layboy according to claim 3, wherein the vertical piston-and cylinder units (24) are positioned at a distance from the first means (23 & 25), each piston-and-cylinder unit having a second piston-and-cylinder unit (27) for moving said gripper (26) horizontally.

5. A layboy according to claim 1, including means for guiding the forks (20) to a position above the infeed level while the forks travel toward the stack.

6. A layboy according to claim 1, including lateral guides (29) which control the movement of the forks (20) along a continuous path.

7. A layboy according to claim 1, including means (28) for synchronizing the descent of the forks (20) with the descent of the layoff platform (5).

8. A layboy according to claim 1, including spindle-driven lifters (28) that force the forks (20) down when inserted in the stack in synchronization with the layoff platform (5).

* * * * *